US006382252B1

(12) United States Patent
Moore et al.

(10) Patent No.: US 6,382,252 B1
(45) Date of Patent: May 7, 2002

(54) CONTROL UNIT FOR FLUID CONTROL VALVES

(75) Inventors: Dudley Moore, Saffron Walden; Ashley Hopper, Ramsgate, both of (GB)

(73) Assignee: Eco-Logic (UK) EMPS Limited, Birmingham (GB)

( * ) Notice: Subject to any disclaimer, the term of this patent is extended or adjusted under 35 U.S.C. 154(b) by 0 days.

(21) Appl. No.: 09/786,578

(22) PCT Filed: Aug. 26, 1998

(86) PCT No.: PCT/GB99/02814

§ 371 Date: Apr. 23, 2001

§ 102(e) Date: Apr. 23, 2001

(87) PCT Pub. No.: WO00/12830

PCT Pub. Date: Mar. 9, 2000

(30) Foreign Application Priority Data

Aug. 26, 1998 (GB) ..... 9818619

(51) Int. Cl.[7] ..... F16K 31/02

(52) U.S. Cl. ..... 137/624.12; 251/129.04

(58) Field of Search ..... 137/624.11, 624.12, 137/624.13; 251/129.01, 129.04

(56) References Cited

U.S. PATENT DOCUMENTS

| | | | | |
|---|---|---|---|---|
| 4,651,777 A | * | 3/1987 | Hardman | 251/129.01 X |
| 5,038,820 A | * | 8/1991 | Ames et al. | 137/624.12 X |
| 5,217,035 A | | 6/1993 | Van Marcke | |
| 5,327,473 A | | 7/1994 | Weigert | |
| 5,497,135 A | | 3/1996 | Wisskirchen et al. | |
| 5,588,636 A | | 12/1996 | Eichholz et al. | |
| 5,797,417 A | * | 8/1998 | DeLattre et al. | 137/624.12 X |

FOREIGN PATENT DOCUMENTS

| | | |
|---|---|---|
| EP | 415062 | 3/1991 |
| EP | 574372 | 12/1993 |
| EP | 789369 | 8/1997 |
| GB | 2172413 | 9/1986 |
| WO | WO 89/09311 | 10/1989 |

* cited by examiner

*Primary Examiner*—Kevin Lee
(74) *Attorney, Agent, or Firm*—Caesar, Rivise, Bernstein, Cohen & Pokotilow, Ltd.

(57) ABSTRACT

Control apparatus including a plurality of fluid control valves, especially for supplying items of sanitary ware. The valves have magnetic bistable solenoid actuators drivable by pulse signals and a common control circuit able to drive the actuators independently and the control circuit and actuators are driven by a local power supply including a dry cell battery.

35 Claims, 4 Drawing Sheets

CONTROL UNIT FOR FLUID CONTROL VALVES

FIELD OF THE INVENTION

The invention relates to a control unit for controlling electrical apparatus, for example, an electromechanical device such as a solenoid operated fluid control valve. While the control unit is capable of a wide variety of uses it is seen to good effect in the control of a number of valves supplying a fluid such as water to a tap, shower unit, toilet or any combination; or the like. Thus, more particularly, but not exclusively, the invention relates to a toilet facility with a control unit and valves arranged for supplying water to respective items of sanitary ware; for example, a shower, wash basin and water closet (WC) or several showers (say).

BACKGROUND OF THE INVENTION

Electrically controlled water valves have utility in plumbing installations and toilet facilities where water saving is particularly important, where misuse is likely, or simply for safety and ease of use, say in a toilet facility intended for use by an elderly or disabled person.

Electrical battery powered valves are preferred for safety and ease of installation.

European Patent No. EP 0574372 A1 discloses control apparatus comprising a plurality of fluid control valves, respective solenoid actuators coupled to the valves and a controller for supplying control signals to the valves.

SUMMARY OF THE INVENTION

According to one aspect of the invention, there is provided control apparatus comprising a plurality of fluid control valves respective solenoid actuators coupled to the valves and a controller for supplying control signals to the valves, characterised in that each solenoid actuator is a magnetic bistable solenoid actuator (100 FIG. 5) for opening and closing the respective valve (5), the actuator comprising an armature movable (101) between two positions corresponding to the open and closed states of the valve and electromechanical drive means (102, 103) for being driven by respective electrical drive pulses to move the armature between said positions; the armature then remaining in the position to which it is moved; the apparatus including:

- for each actuator respective input signal supply means (22) for controlling the actuators and output signal forming means (10, 50, 60, 70) connected to the actuator and operable for supplying said respective electrical drive pulses;
- micro processor-based control circuit means common to actuators, the corresponding input signal forming means and the corresponding output signal forming means for controlling the valves independently one from another;
- local power supply means, for example dry cell battery means (7), connected to said control circuit means and said output signal forming means and operable for supplying the power for driving the control apparatus and said pulses.

The apparatus to be described conserves power by using bistable actuators and providing a simple controller that independently controls respective input switch/output drive actuator circuits.

The control circuit means may comprise a microcontroller connected to said output signal forming means; and memory means for storing a programmed and data for causing the microcontroller to respond to said input signal supply means for independently controlling said valves. The input signal supply means may comprise one or more control switches for each control device.

Advantageously the control apparatus comprises manually operable switch means connected to the control circuit means for causing any of said valves to open for a selected one of two or more different preset time intervals.

The switch means may comprise a first switch operable via the control means for causing a respective valve to open for a first preset time interval and a second switch operable via the control means for causing that valve to open for a relatively much shorter second preset time interval.

Advantageously the control circuit means permits the valve to be opened for said second preset time interval only a predetermined number of times following the opening of the valve for said first preset time interval.

When any valve is open, the respective second switch may become operable via the control circuit means for closing that valve.

Preferably, the control circuit means is responsive to the switch means for becoming operable to set said device into a predetermined control state and for recording a value representative of a time interval during which the valve is in said state, and the control circuit then becoming operable in response to said switch means for setting said valve into said predetermined control state for a time equal to two or more times said time interval.

According to another aspect of the invention, there is provided apparatus comprising a plurality of items of sanitary ware, corresponding water control valves connected to the items, respective solenoid actuators coupled to the valves and a controller connected to the actuators, characterised in that each solenoid actuator is a magnetic bistable solenoid actuator for opening and closing the respective valve, and the facility comprising for each valve, respective switch means connected to said control circuit for controlling that valve independently from the other valves; and output signal means (10, 50, 60, 70) for driving the respective actuators;

- a single microprocessor-based control circuit connected to the water control valves for responding to the switch means to control the actuators.
- a dry cell battery power supply means coupled to the control circuit for supplying power to operate the control circuit and, via the control circuit, energising said control valves.

Each switch means may comprise two or more switches for causing the respective valve to open for respective predetermined time intervals.

According to yet another aspect of the invention there is provided a control unit arranged to control the opening and closing of at least two valves such as latching solenoid valves to transfer fluid to respective outlets from a common source or separate sources of said fluid, the control unit comprising:

- one or more manually operable switches for each valve to initiate opening and dosing of the valve;
- timing means arranged to control the time period for which each valve is open;
- override means to cut short the predetermined time period;
- a top up/off switch arranged to open one or more valves for a limited number of time cycles and, as a secondary function, for closing said valves if they are open;
- lock-out switch means operable for closing the valves for predetermined intervals;

a lock out key switch to close the valves; and a dry cell battery power source to provide power for the control unit and, via the control unit, for the valves.

Preferably the unit includes temperature control means.

Preferably the control unit comprises two channels each to control a respective valve, each channel having a number of switch inputs, some of these inputs can be time programmed while another of which is enabled only when one of the other inputs is enabled. This other input is arranged to override the others when the flow valve is open or to augment the flow valve if at the time of energisation the valve is shut.

One or more auxiliary channels may be present and will then be arranged to have a simple on/off switch function.

By splitting the power load into a number of switches each of which is energised according to the circumstances the power required is reduced and a single dry cell (or a few) can be used for a plurality of valves.

The design of the device to be described is such that it can be programmed to give various ways of operating and to set up different chosen time values and such.

BRIEF DESCRIPTION OF THE DRAWINGS

In order that the invention may be well understood it will now be described by way of example, with reference to the accompanying drawings, in which.

DESCRIPTION OF THE PREFERRED EMBODIMENT

Figure 1:
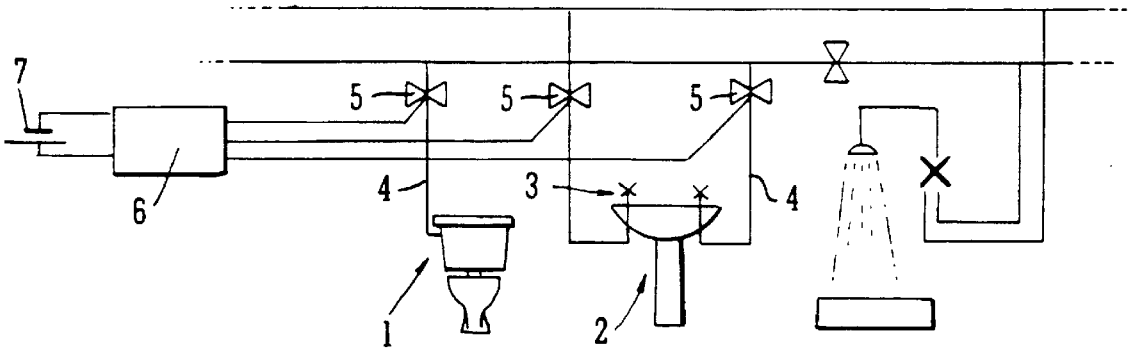
FIG. 1 is a diagram of a toilet facility.

The toilet facility of FIG. 1 comprises a WC (water closet) 1 and a washbasin 2 with hot and cold taps (faucets) 3. The WC 1 and the taps 3 are supplied with water via respective pipes 4 each including an electrically operable shut-off valve 5.

Figure 5:
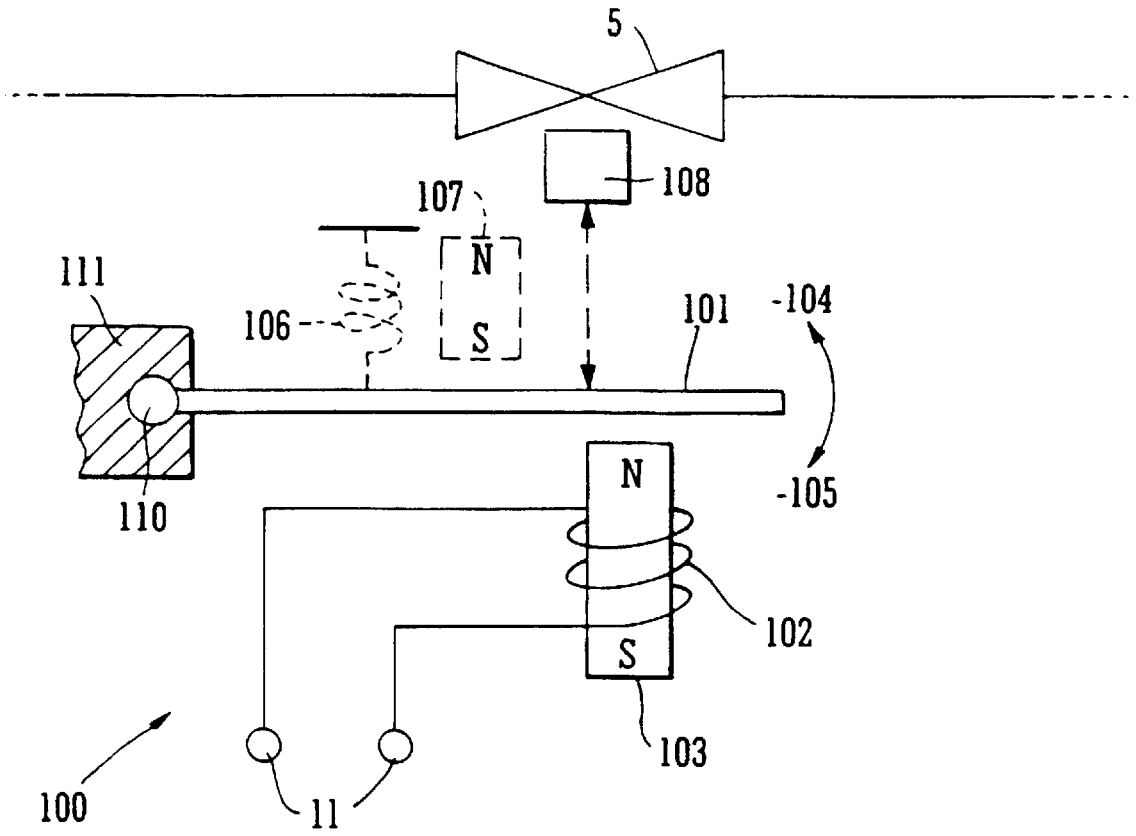
FIG. 5 is a simplified diagram of a valve with a bistable solenoid actuator.

As shown in the diagram of FIG. 5, each shut-off valve 5 comprises a bistable solenoid actuator 100 for switching the valve 5 between its on and off states. The bistable solenoid actuator has an armature 101 pivotably mounted at end 110 to a support 111, an electromagnetic drive coil 102 and a permanent holding magnet 103. The armature 101 is coupled to the valve member (as indicated by dashed line 109) of the valve 5 and is movable between first and second limit positions 104 and 105 corresponding to the off and on states of the valve. If the armature 101 is at the second limit position 105 it remains held in this position by the holding magnet 103. If the armature is at the first position 104, it remains there because the holding magnet is not strong enough on its own to cause the armature to move. However, by applying a first pulse signal to the electromagnetic coil, the holding magnet 103 is supplemented by the field due to the electromagnetic coil 102 and then the armature does move to the second limit position 105. To release the armature from being held by the holding magnet, a reverse polarity pulse is applied to the coil. This not only overcomes the attractive force of the holding magnet but actually drives the solenoid armature back to its first limit position 104. Thus, the solenoid actuator 100 is operated, i.e. driven between its valve open and valve closed positions by short pulses only and no position-maintaining drive signal need be supplied.

The armature 108 may be coupled to spring means 106 or another permanent magnet 107 arranged to maintain it gently held back to its first limit position 104 or there may be no such spring means and other permanent magnet.

Each valve may be of the kind in which a valve member is moved to shut off or release the flow of water directly or, as shown in the drawings the valve may have one or more stages 108 of indirect or "servo" control, e.g. in which the valve member controls a small bleed hole in a diaphragm or the like so allowing or releasing a pressure build-up which in turn results in movement of the diaphragm and control of the water flow through the valve. The valves are controlled by a microprocessor based control unit 6 powered by a lithium manganese dioxide dry cell battery 7.

Figure 2:
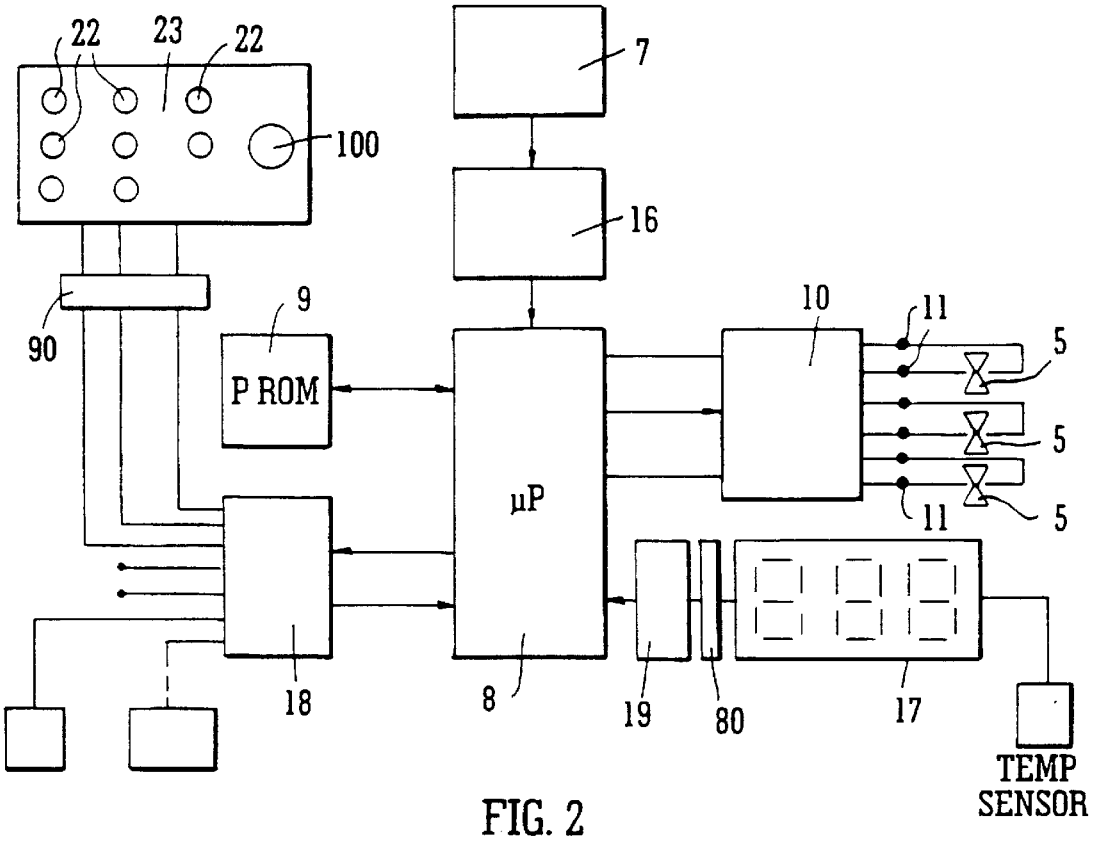
FIG. 2 is a simplified circuit diagram of a control unit.
Figure 3:
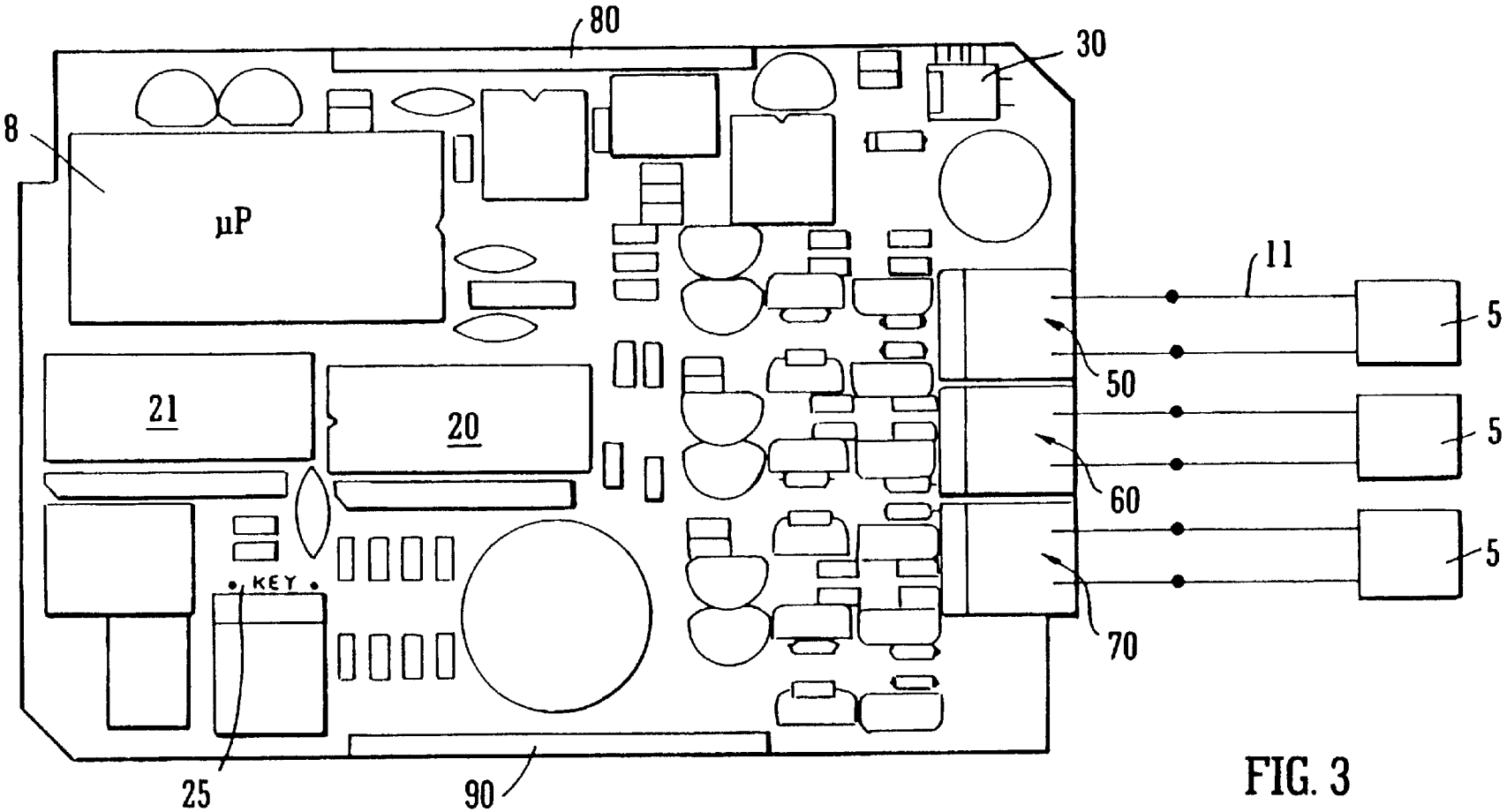
FIG. 3 is a plan view of a circuit board of the control unit.
Figure 4:
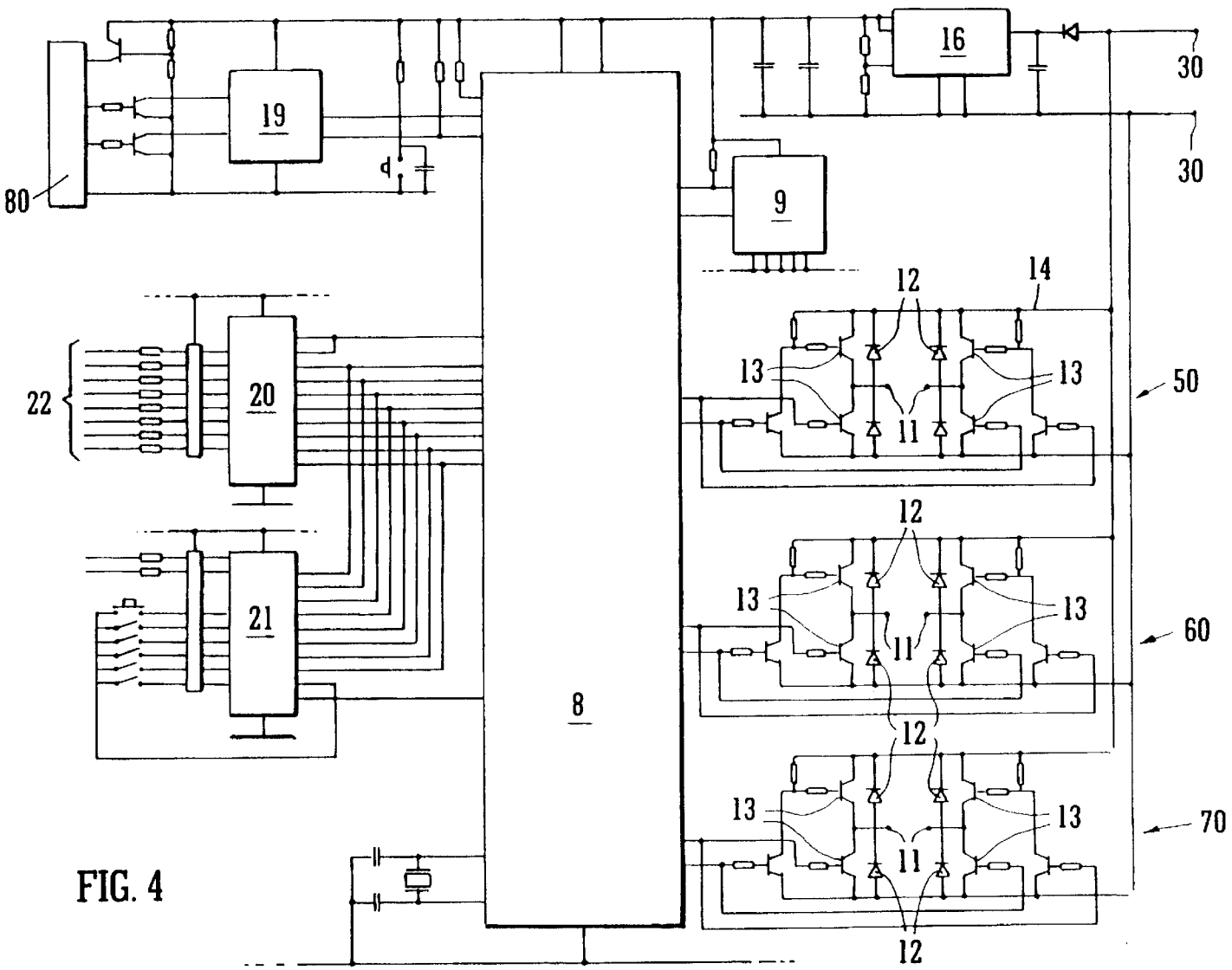
FIG. 4 is a circuit diagram of the control unit.

As shown in FIGS. 2 to 4, each control unit 6 comprises a microcontroller 8 and an electrically erasable programmable read-only memory (EEPROM) 9 connected to the microcontroller and containing the program and data for the microcontroller 8.

The pulse signals for driving the valves are supplied by respective driver circuits 10. Each driver circuit has two output terminals 11 connected to the respective valve. The output terminals 11 in each drive circuit are connected via diodes 12 and via NPN/PNP transistor pairs 13 to high and low supply rails 14 and 15 respectively, connected to the battery 7. The microcontroller 8 and other semiconductor devices in the control unit 6 are driven by the battery 7 via a constant voltage regulator 16.

The microcontroller 8 is also coupled via microprocessor 19 and connector unit 80 to a sensor/display unit 17. The function of the microprocessor 19 is to receive the temperature indicative signals from the temperature sensor of the unit 17, to process these signals and compare them with an appropriate over-temperature threshold. The microprocessor then supplies an automatic over-temperature shut down signal to the unit 8. The sensor/display unit 17 may comprise a commercially available pre-made unit, basically a digital thermometer, perhaps with adaptation as appropriate. The sensor/display unit may, of course, comprise yet another microcontroller for running the digital display.

The control unit also has a switch interface circuit 18 which comprises two eight bit registers 20 and 21 having outputs multiplexed into respective signal inputs of the microcontroller 8.

The register 20 is settable in accordance with eight push button switches 22 comprises in a control panel 23 while register 21 reflects the state of five DIP switches 23 and a push button switch 24 mounted on the printed circuit board of the control unit 8. The register 21 is also connected to input terminals 25 and 26 for receiving an optional external input signal and an optional key switch (not shown).

The circuit board (PCB) of the control unit has terminals 30 for connection to a 6v dry cell battery such as lithium manganese dioxide battery. The microcontroller 28 pin IC with two sets of pins leading to respective output sub-circuits (50, 60 and 70) each to control a respective valve. The master IC is also connected to button input chip 20 and via chip 21 to an external I/P and key switch terminals 25 and 26, the DIP switches 23, a push-button and to the connector 80 for the temperature sensor/display module circuit 17. Chip 20 is coupled to connector 90 for linking to switches 22 on panel 23.

The circuit board of FIG. 3 is the main control board for a system incorporating valves V1, V2, V3 and so on, e.g. for tap, shower and W.C. control.

The board can independently control up to 3 latching solenoid valves, V1, V2, V3. These open' or close according to manual operation of switches not shown. The valve 'open' times can be set to any value within a wide range, but the valves can also be closed early at any time. There is provision for a key operated switch 100 that will act as a LOCKOUT, whereby all valves will be closed and all switch inputs will be inhibited during its operation.

Certain switch inputs have additional attributes such as TOP UP/STOP function and the third channel can be closed if the temperature sensor circuit 17 detects a temperature beyond the set high limit. Functions can be enabled or disabled as desired.

If required, to help prevent overfilling, restrict water use or provide a safety control, a 'disable' time can be provided so that after a fill has taken place, no further fills can be started for a set periods (channels 1 and 2 only). The TOP UP/STOP continues to be available, subject to a maximum of 5 operations.

Valve Channels 1 and 2

These are two separate, but identical channels. Each channel has 4 switch inputs, one of which may be designated as TOP UP/STOP, and each switch can have its own respective FILL TIME programmed with it.

For the first 3 switch inputs, the valve will open for the pre-programmed period, then close. In addition, the 3 switches themselves can be set either, (a) to be disabled whilst filling is taking place or, (b) to allow a second operation to close the valve. If the fourth switch is set to be TOP UP/STOP, it will only be enabled following a fill operation commenced by one of the first 3 switches. Whilst the valve is open, this switch will act as a STOP, closing the valve and cancelling the current fill time. Whilst the valve is closed, the switch becomes TOP UP and a maximum of 5 operations are allowed before this switch becomes disabled.

If the fourth switch is set to be ON/OFF, it will always be available to commence a fill, and then a second push will close the valve.

if the unit is set by dipswitches to give a DELAY TIME, switches 1 to 3 will be disabled for this time period following a fill, but the TOP UP/STOP will remain enabled.

Valve Channel 3

This channel has one switch associated with it, connected to the Ext I/P terminals, and would usually be used for shower control. This channel can have its own fill time programmed with it. Operating the switch will cause the valve to open for a preset period, whilst operating the switch a second time will cause the valve to close.

Temperature Module

The module senses and displays the water temperature at a suitable point and if the optional auto-close module is fitted, when the temperature reaches 43° C. or above the valve will close. The valve cannot be opened whenever the temperature exceeds this setting.

Lockout Keyswitch

The lockout keyswitch can be used to prevent unauthorised personnel from operating the unit. Whilst in the lockout condition, all valves will be closed and all switch inputs become disabled.

Setup

From stages 1 and 2 below, choose the fill times and mode of operation required. The unit will normally be supplied with 'default' settings, whereby all the fill times are set to zero so the unit will not respond to any switch inputs until it has been setup.

The unit can be returned to 'default' settings whereby all fill times are set to zero by implementing stage 3.

All settings will remain in the board's memory even if the battery is disconnected for prolonged periods.

1. Programming Fill Time is the Same for Each Switch, and Must Be Followed for Each and Every One Used
   - i) Ensure the battery is connected and that the LOCKOUT is off.
   - ii) Press and release the PROG button (any open valves will close).
   - iii) Determine what run time or fill time is required for the switch to be programmed. Press that fill switch—the respective valve will open. Once the desired run time has elapsed (or the fill level is achieved), press the same fill switch again—the valve will close.
   - iv) Wait 2 seconds to allow the memory to be updated.
   - v) Repeat steps (ii) to (iv) for all other fill switches.
2. Programming Each Switch for ON or ON/OFF Operation
   - ON Mode—once fill is started, subsequent switch operations are ignored
   - ON/OFF mode—alternate switch operations open and close the valve.

The unit will normally be supplied with each of the first 3 switches on channels 1 and 2 set for ON/OFF operation and the fourth switch as TOP UP/STOP. If required, the first 3 switches can be reprogrammed for ON mode operation, and the fourth switch can be reprogrammed as ON/OFF.

For channel 3, only ON/OFF is provided and cannot be altered.

Check the current setting for each switch by trial—only reprogrammed if an alternative setting is required.

- (i) Ensure the battery is connected and that LOCKOUT is off.
- (ii) Press and release the PROG button (any open valves will close).
- (iii) Operate the LOCKOUT then return to the 'off' position.
- iv) Press the appropriate switch to be programmed.
- v) Wait 2 seconds to allow the memory to be updated.

3. Programming All Switches Disabled
   - (i) Ensure the battery is connected and that the LOCKOUT is off.
   - (ii) Press PROG and hold down for at least 3 seconds (any open valves will close).
   - (iii) Wait 2 seconds to allow the memory to be updated.
4. Dipswitch Settings These can be changed at any time, but it is recommended to leave this until all the above programming steps have been made and the correct fill times and modes have been checked.

There are 5 dipswitches that operate as detailed below. The dipswitch is 'on' when it is in the up position and 'off' when it is down.

| | Switches | | | | |
|---|---|---|---|---|---|
| Channels 1 & 2 | 1 | 2 | 3 | 4 | DELAY TIME |
| | off | off | off | off | ZERO |
| | on | off | off | off | 5 minutes |
| | off | on | off | off | 10 minutes |
| | on | on | off | off | 15 minutes |
| | off | off | on | off | 20 minutes |
| | on | off | on | off | 25 minutes |
| | off | on | on | off | 30 minutes |
| | on | on | on | off | 35 minutes |
| | off | off | off | on | 40 minutes |
| | on | off | off | on | 45 minutes |

-continued

| Channels 1 & 2 | Switches 1 | 2 | 3 | 4 | DELAY TIME |
|---|---|---|---|---|---|
| | off | on | off | on | 50 minutes |
| | on | on | off | on | 55 minutes |
| | off | off | on | on | 60 minutes |
| | on | off | on | on | 65 minutes |
| | off | on | on | on | 70 minutes |
| | on | on | on | on | 75 minutes |

EXAMPLE

Say a shower time of 5 minutes (300 seconds) is required, this could be achieved in two ways.

a) Follow setup stage 1, waiting the full 5 minutes between pressing the fill switch for the open and close times. Then leave dipswitch pole 5 off b) Follow setup stage 1, but wait just 30 seconds between pressing the fill switch for the open and close times. Put dipswitch pole 5 on (10×30=300 seconds).

It will be seen that the control unit has been constructed to provide a multiplicity of functions for a plurality of valves, all powered from a single dry cell battery.

The invention is not just applicable to toilet facilities, plumbing installations or even fluid control valves. Instead, a control unit as described may be used in other situations. In particular, the method described at b) above for programming a time value into a control unit is generally useful.

The power supply used in the described embodiments could be adapted for mains operation, or for receiving power from a local supply such as a large battery, but with back-up from the dry cell battery mentioned. The battery could be rechargeable and arranged to be rechargeable whilst in situ or elsewhere.

What is claimed is:

1. Control apparatus comprising a plurality of fluid control valves, respective solenoid actuators coupled to the valves and a controller for supplying control signals to the valves, wherein each solenoid actuator is a magnetic bistable solenoid actuator for opening and closing the respective valve, the actuator comprising an armature movable between two positions corresponding to the open and closed states of the valve and electromechanical drive means for being driven by respective electrical drive pulses to move the armature between said positions; the armature then remaining in the position to which the armature is moved; the apparatus including for each actuator respective input signal forming means for controlling the actuators and output signal forming means connected to the actuator and operable for supplying said respective electrical drive pulses; a micro processor-based control circuit, the corresponding input signal forming means and the corresponding output signal forming means for controlling the valves independently one from another; input signal supply means for providing control signals to the control circuit; and a local power supply connected to said control circuit and said output signal forming means and operable for supplying the power for driving the control apparatus and said pulses.

2. Control apparatus according to claim 1, wherein the control circuit comprises a microcontroller connected to said output signal forming means, and memory means for storing a programmed and data for causing the microcontroller to respond to said input signal supply means for independently controlling said valves.

3. Control apparatus according to claim 1, wherein then input signal supply means comprises one or more control switches for each valve.

4. Control apparatus according to claim 2, wherein the input signal supply means comprises one or more control switches for each valve.

5. Control apparatus according to claim 1, comprising a manually operable switch unit connected to the control circuit for causing any of said valves to open for a selected one of two or more different preset time intervals.

6. Control apparatus according to claim 2, comprising a manually operable switch unit connected to the control circuit for causing any of said valves to open for a selected one of two or more different preset time intervals.

7. Control apparatus according to claim 3, comprising a manually operable switch unit connected to the control circuit for causing any of said valves to open for a selected one of two or more different preset time intervals.

8. Control apparatus according to claim 5, wherein said manually operable switch unit comprises a first switch operable via the control circuit for causing a respective valve to open for a first preset time interval and a second switch operable via the control circuit for causing the respective valve to open for a relatively much shorter second preset time interval.

9. Control apparatus according to claim 6, wherein said manually operable switch unit comprises a first switch operable via the control circuit for causing a respective valve to open for a first preset time interval and a second switch operable via the control circuit for causing the respective valve to open for a relatively much shorter second preset time interval.

10. Control apparatus according to claim 7, wherein said manually operable switch unit comprises a first switch operable via the control circuit for causing a respective valve to open for a first preset time interval and a second switch operable via the control circuit for causing the respective valve to open for a relatively much shorter second preset time interval.

11. Control apparatus according to claim 14, further comprising a switch unit having a first switch operable via the control circuit for causing a respective valve to open for a first preset time interval and a second switch operable via the control circuit for causing the respective valve to open for a relatively much shorter second preset time interval.

12. Control apparatus according to claim 8, wherein the control circuit permits the valve to be opened for said second preset time interval only a predetermined number of times following the opening of the valve for said first preset time interval.

13. Control apparatus according to claim 9, wherein the control circuit permits the valve to be opened for said second preset time interval only a predetermined number of times following the opening of the valve for said first preset time interval.

14. Control apparatus according to claim 10, wherein the control circuit permits the valve to be opened for said second preset time interval only a predetermined number of times following the opening of the valve for said first preset time interval.

15. Control apparatus according to claim 11, wherein the control circuit permits the valve to be opened for said second preset time interval only a predetermined number of times following the opening of the valve for said first preset time interval.

16. Control apparatus according to claim 5, wherein the control circuit permits a valve to be opened for a second of the preset time intervals only a predetermined number of times following an opening of a valve for a first of the preset time intervals.

17. Control apparatus according to claim 8, wherein when any valve is open the respective second switch is operable via the control circuit for closing that valve.

18. Control apparatus according to claim 9, wherein when any valve is open the respective second switch is operable via the control circuit for closing that valve.

19. Control apparatus according to claim 10, wherein when any valve is open the respective second switch is operable via the control circuit for closing that valve.

20. Control apparatus according to claim 11, wherein when any valve is open the respective second switch is operable via the control circuit for closing that valve.

21. Control apparatus according to claim 5, wherein the control circuit is responsive to the switch unit for becoming operable to set said control apparatus into a predetermined control state and for recording a value representative of a time interval during which the valve is in said state, and the control circuit then becoming operable in response to said switch unit for setting said valve into said predetermined control state for a time equal to about two or more times said time interval.

22. Control apparatus according to claim 6, wherein the control circuit is responsive to the switch unit for becoming operable to set said control apparatus into a predetermined control state and for recording a value representative of a time interval during which the valve is in said state, and the control circuit then becoming operable in response to said switch unit for setting said valve into said predetermined control state for a time equal to about two or more times said time interval.

23. Control apparatus according to claim 7, wherein the control circuit is responsive to the switch unit for becoming operable to set said control apparatus into a predetermined control state and for recording a value representative of a time interval during which the valve is in said state, and the control circuit then becoming operable in response to said switch unit for setting said valve into said predetermined control state for a time equal to about two or more times said time interval.

24. Control apparatus according to claim 11, wherein the control circuit is responsive to the switch unit for becoming operable to set said control apparatus into a predetermined control state and for recording a value representative of a time interval during which the valve is in said state, and the control circuit then becoming operable in response to said switch unit for setting said valve into said predetermined control state for a time equal to about two or more times said time interval.

25. Control apparatus according to claim 8, wherein the control circuit is responsive to the switch unit for becoming operable to set said control apparatus into a predetermined control state and for recording a value representative of a time interval during which the valve is in said state, and the control circuit then becoming operable in response to said switch unit for setting said valve into said predetermined control state for a time equal to about two or more times said time interval.

26. Control apparatus according to claim 9, wherein the control circuit is responsive to the switch unit for becoming operable to set said control apparatus into a predetermined control state and for recording a value representative of a time interval during which the valve is in said state, and the control circuit then becoming operable in response to said switch unit for setting said valve into said predetermined control state for a time equal to about two or more times said time interval.

27. Control apparatus according to claim 10, wherein the control circuit is responsive to the switch unit for becoming operable to set said control apparatus into a predetermined control state and for recording a value representative of a time interval during which the valve is in said state, and the control circuit then becoming operable in response to said switch unit for setting said valve into said predetermined control state for a time equal to about two or more times said time interval.

28. Control apparatus according to claim 1, said power supply comprising a dry cell battery.

29. Apparatus comprising a plurality of sanitary ware units, corresponding water control valves connected to the units, respective solenoid actuators coupled to the valves and a controller connected to the actuators, wherein each solenoid actuator is a magnetic bistable solenoid actuator for opening and closing the respective valve, each valve having a respective switch unit for controlling the respective valve independently from the other valves, and output signal means for driving the respective actuators, a single microprocessor-based control circuit connected to the water control valves for responding to the switch unit to control the actuators, a power supply coupled to the control circuit for supplying power to operate the control circuit and, via the control circuit, energising said control valves.

30. Apparatus according to claim 29, wherein each switch unit comprises two or more switches for causing the respective valve to open for respective predetermined time intervals.

31. Apparatus according to claim 29, further including temperature sensing means for sensing the temperature of water supplied by the valves and for providing an over-temperature signal to the controller.

32. Apparatus according to claim 30, further including temperature sensing means for sensing the temperature of water supplied by the valves and for providing an over-temperature signal to the controller.

33. Apparatus according to claim 29 wherein the power supply is operable for being driven by mains or other electrical supply and further includes a dry cell battery operable as a back-up power supply.

34. Apparatus according to claim 30 wherein the power supply is operable for being driven by mains or other electrical supply and further includes a dry cell battery operable as a back-up power supply.

35. Apparatus according to claim 34 wherein the power supply is operable for being driven by mains or other electrical supply and further includes a dry cell battery operable as a back-up power supply.

* * * * *